United States Patent [19]

Phillips

[11] Patent Number: 4,497,627

[45] Date of Patent: Feb. 5, 1985

[54] HOT SHOE APPARATUS FOR PREHEATING DRAFTING, AND STABILIZING IN SEQUENCE A RUNNING YARN STRAND

[75] Inventor: Bobby M. Phillips, Kingsport, Tenn.

[73] Assignee: Eastman Kodak Company, Rochester, N.Y.

[21] Appl. No.: 582,679

[22] Filed: Feb. 23, 1984

[51] Int. Cl.[3] ..... F27B 9/28; C21D 9/52

[52] U.S. Cl. ..... 432/59; 266/102; 266/103; 432/8

[58] Field of Search ..... 432/8, 59; 266/102, 266/103

[56] References Cited

U.S. PATENT DOCUMENTS

| | | | |
|---|---|---|---|
| 1,916,372 | 7/1933 | Hepburn et al. | 432/8 |
| 3,387,833 | 6/1968 | Whittaker et al. | 432/8 |
| 3,559,255 | 2/1971 | Cockroft | 432/59 |
| 3,671,623 | 6/1972 | Fukushima et al. | 264/288.8 |
| 3,857,673 | 12/1974 | Andrus | 432/59 |

*Primary Examiner*—John J. Camby

*Attorney, Agent, or Firm*—Malcolm G. Dunn; William P. Heath, Jr.

[57] ABSTRACT

Apparatus for preheating, drafting, and stabilizing in sequence a running yarn strand and including a heated shoe device, freely rotating idler rolls at each end of the heated shoe device and a fixed draw pin with the heated shoe device having two different temperature zones by which the running yarn strand is preheated prior to being drawn when passing over the fixed draw pin, and is thereafter heat stabilized.

6 Claims, 6 Drawing Figures

HOT SHOE APPARATUS FOR PREHEATING DRAFTING, AND STABILIZING IN SEQUENCE A RUNNING YARN STRAND

DESCRIPTION

1. Technical Field

My invention relates to the manufacture of synthetic yarns made from polymeric materials and more particularly to an apparatus for preheating, drafting, and stabilizing in sequence a running yarn strand made from such polymeric materials.

2. Background Art

In the manufacture of synthetic yarns such as from linear polyesters like the polyethylene terephthalates disclosed by Whinfield and Dickson in U.S. Pat. No. 2,465,319, molten polymer is typically extruded through a spinneret in a multitude of individual streams, the individual streams solidify into filaments upon cooling, and then the filaments are drawn to several times their original length so as to establish desirable physical properties such as tenacity, elongation, and shrinkage. The step of drawing, either in the form of filaments, yarns, or tows, is critical as nonuniform drawing will result in nonuniform dyeing, which is usually undesirable in dyed fabrics, for instance.

In air texturing yarns, such as polyester and other types of yarns as disclosed in U.S. Pat. No. 4,245,001, drafting of these yarns becomes very important and especially so if any reasonable commercially practical speeds are to be obtained. It is well known, for instance, that the best drawing of polyester yarns, for example, is obtained when the yarn is pretensioned, preheated, drafted with a localized draw point, and heat stabilized, such as disclosed, for example, in U.S. Pat. No. 3,671,623.

DISCLOSURE OF THE INVENTION

In accordance with the present invention, I provide an apparatus for preheating, drafting, and stabilizing in sequence a running yarn strand. The apparatus involves a heated shoe device having a pair of oppositely facing convex surfaces adapted to be heated and over which a running yarn strand travels in contact therewith to be heated to a predetermined temperature, and an arrangement within the heated shoe device for heating the pair of oppositely facing convex surfaces. The apparatus also includes a first freely rotating idler roll and a second freely rotating idler roll spaced one from the other and upstream along a running yarn strand path from the heated shoe device at one end thereof; a third freely rotating idler roll and a fourth freely rotating idler roll spaced one from the other and downstream along the running yarn strand path from the heated shoe device at the opposite end thereof; and a fixed draw pin spaced upstream along the running yarn strand path from the first and second freely rotating idler rolls.

The freely rotating idler rolls and the heated shoe device together define multiple running yarn strand paths for the running yarn strand as the running yarn strand passes back and forth along the yarn strand paths a predetermined number of times over the first freely rotating idler roll; along one of the pair of oppositely facing convex surfaces of the heated shoe device to the fourth freely rotating idler roll for return over the heated shoe device along the other of the pair of oppositely facing convex surfaces of the heated shoe device; next from the fourth freely rotating idler roll over the heated shoe device to the fixed draw pin for drawing the running yarn strand; and then from the draw pin back and forth over the second freely rotating idler roll, heated shoe device, and the third freely rotating idler roll a predetermined number of times before exiting downstream along the running yarn strand path from the apparatus.

The heated shoe device defines along the width of its pair of oppositely facing convex surfaces a first temperature zone for preheating the running yarn strand in its back and forth travel between the first and fourth freely rotating idler rolls, and a second temperature zone for heat stabilizing the running yarn strand in its back and forth travel between the second and third freely rotating idler rolls at a temperature higher than the first temperature zone.

The side wall of the heated shoe device adjacent the second temperature zone is provided with an arrangement for cooling each of the pair of oppositely facing convex surfaces of the heated shoe device along the first temperature zone. The arrangement for cooling each of the pair of oppositely facing convex surfaces of the heated shoe device comprises perforations through the side wall adjacent to the second temperature zone.

An insulating arrangement may be provided between the first and second temperature zones, and the arrangement for heating the heated shoe device includes a separate heating arrangement for each of the temperature zones.

Each of the pair of oppositely facing convex surfaces may have slots formed therethrough along the direction of the length of the heated shoe device along the running yarn strand paths within the first temperature zone and the running yarn strand travels within the slots out of contact with the surfaces of the heated shoe device.

The axes of the fixed draw pin and freely rotating idler rolls lie in a common plane, which is also coextensive with the axial length of the heated shoe device.

BRIEF DESCRIPTION OF THE DRAWINGS

The details of my invention will be described in connection with the accompanying drawings, in which.

BEST MODE FOR CARRYING OUT THE INVENTION

Figure 2:
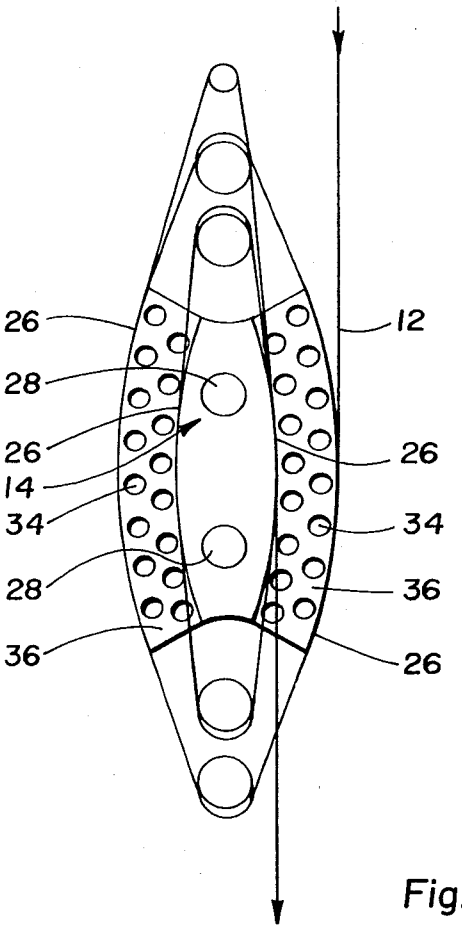
FIG. 2 is an end elevational view of the apparatus shown in FIG. 1 and illustrating the perforations for cooling a portion of the width of the heated shoe device.
Figure 1:
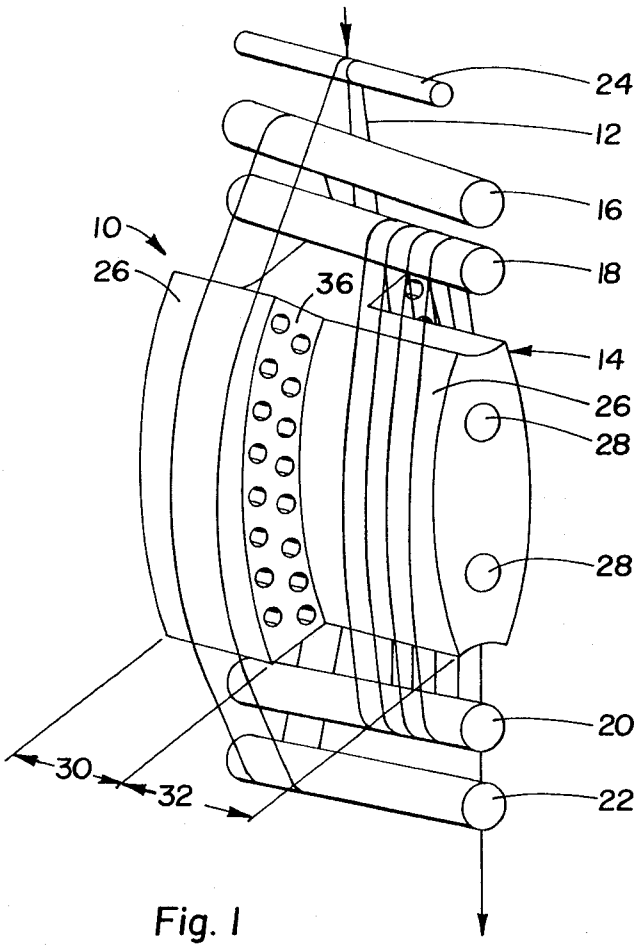
FIG. 1 is an isometric view of the apparatus showing the heated shoe device, fixed draw pin, freely rotating idler rolls, and the running yarn strand paths and illustrating perforations in the first temperature zone of the heated shoe device by which a portion of the width of the heated shoe device is cooled.

In reference to FIGS. 1 and 2, 10 designates the apparatus for preheating, drafting, and stabilizing in sequence a running yarn strand 12. The apparatus includes a heated shoe device 14, a first freely rotating idler roll 16 and a second freely rotating idler roll 18 spaced one from the other and upstream along the illustrated running yarn strand path from the heated shoe device at one end thereof. A third freely rotating idler roll 20 and a fourth freely rotating idler roll 22 are also spaced one from the other but downstream along the running yarn strand path from the heated shoe device 14 at the opposite end thereof. A fixed draw pin 24 is spaced upstream along the running yarn strand path from the first and second freely rotating idler rolls 16 and 18. As will be observed from FIG. 2 the axes of the fixed draw pin and of the freely rotating idler rolls lie in a common plane, which is also coextensive with the axial length of the heated shoe device 14. The freely rotating idler rolls 16, 18, 20, and 22 are appropriately skewed in a manner well known in the art to provide the separate yarn strand paths illustrated in FIG. 1, for instance.

The heated shoe device 14 has a pair of oppositely facing convex surfaces 26 (FIG. 2) which are adapted to be heated, such as by conventional cartridge heaters 28 (FIG. 2), so that the convex surfaces against which the running yarn strand 12 travels in contact therewith are heated to a predetermined temperature.

The freely rotating idler rolls 16, 18, 20, and 22 and the heated shoe device 14 together define multiple running yarn strand paths, as illustrated in FIG. 1, for instance, for the running yarn strand 12. The running yarn strand passes back and forth along the yarn strand paths a predetermined number of times over the first freely rotating idler roll 16, along one of the pair of oppositely facing convex surfaces 26 of the heated shoe device to the fourth freely rotating idler roll 24 for return over the heated shoe device along the other of the oppositely facing convex surfaces of the heated shoe device. Next, the running yarn strand passes from the fourth freely rotating idler roll over the heated shoe device to and around the fixed draw pin 24 for drawing the running yarn strand, and then from the draw pin back and forth over the second freely rotating idler roll, heated shoe device and the third freely rotating idler roll a predetermined number of times before exiting downstream along the running yarn strand from the apparatus 10.

The heated shoe device 14 defines along the width of its pair of oppositely facing convex surfaces 26 a first temperature zone 30 for preheating the running yarn strand in its back and forth travel between the first and fourth freely rotating idler rolls 16, 22, and a second temperature zone 32 for heat stabilizing the running yarn strand in its back and forth travel between the second and third freely rotating idler rolls 18,20 at a temperature higher than the first temperature zone.

In order to obtain different temperatures for the two temperature zones 30,32, with the cartridge heaters 28 operating at a fixed temperature, the portion of the width of the heated shoe device representing the first temperature zone may be enlarged as illustrated and then provided with perforations 34 through the side wall 36, from which heat will escape, thereby enabling the first temperature zone to operate at a cooler temperature than the second temperature zone.

A typical size for the perforations may be 0.635 cm ($\frac{1}{4}$''), the height of the first temperature zone from the second temperature zone may be 1.905 cm ($\frac{3}{4}$'') and the spacing between the perforations on the same level may be 1.429 cm (9/16''), with the perforations on the next level being formed between the perforations on the first-mentioned level. The length of one of the convex surfaces may be 10.16 cm (4'').

Figure 3:
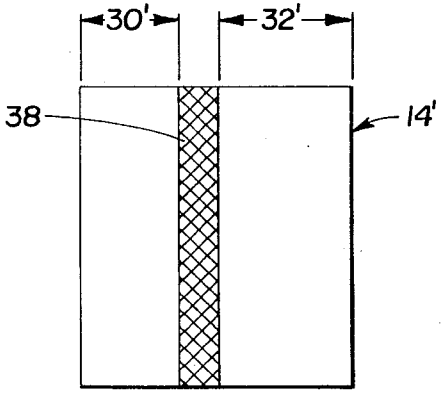
FIG. 3 is an elevational view of an alternate construction of the apparatus shown in FIGS. 1 and 2 and illustrating insulation provided between the first and second temperature zones of the heated shoe device.

FIG. 3 shows an alternate embodiment wherein the apparatus 10' has a heated shoe device 14'' having insulation 38 separating the first temperature zone 30' from the second temperature zone 32', and then separate heating means such as an individual cartridge heater may be provided within the heated shoe device 14' for each zone with each operating at a different temperature from the other. The insulation 38 may be any suitable material or may even be an air gap which will keep the surfaces of the two temperature zones separate from each other.

Figure 6:
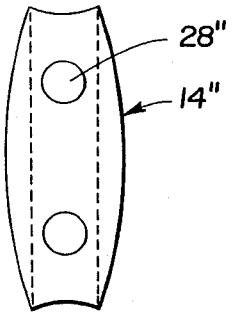
FIG. 6 is an end elevational view of the heated shoe device shown in FIG. 4.
Figure 5:
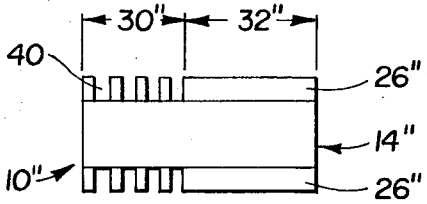
FIG. 5 is a plan view of the heated shoe device shown in FIG. 4.
Figure 4:
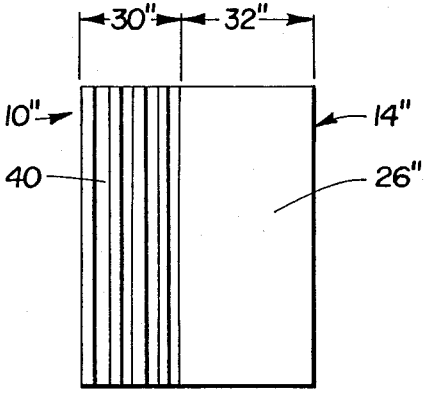
FIG. 4 is an elevational view of another alternate construction of the heated shoe device.and illustrating only the heated shoe device with slots formed through the surface of the first temperature zone along the direction of the length of the heated shoe device.

FIGS. 4, 5, and 6 show still another alternate embodiment wherein the apparatus 10'' has a heated shoe device 14'' having slots 40 formed through each of the pair of oppositely facing convex surfaces 26'' along the direction of the length of the heated shoe device within the first temperature zone 30''. The running yarn strand 12'' travels within the slots 40 out of contact with the surfaces of the heated shoe device. Cartridge heaters, for instance, may also be provided to heat the convex surfaces of the heated shoe device. The slots enable a cooling effect to occur in the first temperature zone 30'' in addition to the fact that the running yarn strand does not touch the surfaces of the heated shoe device and thus is heated to a temperature less than that obtained when in contact with the convex surfaces in the second temperature zone 32''. The diameter of the freely rotating idler rolls must be appropriately sized so that the yarn strand will travel within the slots 40 but without touching the bottom of the slots in the first temperature zone.

The slots 40 may typically be 1.27 cm ($\frac{1}{2}$'') deep and 0.238 cm (3/32'') wide.

The effective operating temperatures for the first temperature zone in the various embodiments of the apparatus may be 80°–110° C. for preheating a running yarn strand of polyester, and 120°–220° C. for heat stabilizing such ruuning yarn strand. For instance in FIG. 1, the running yarn strand is wrapped twice for preheating (100° C.); it is then drawn around a 0.953 cm ($\frac{3}{8}$'') ceramic draw pin with a coefficient of friction of 0.28 ($1\frac{1}{2}$ wraps); and then heat stabilized by being wrapped four times on a surface heated to 160° C.

A significant advantage of the present invention is that the preheating, drawing, and stabilizing are done in sequence by the single apparatus disclosed. Also the preheating temperature and the stabilization temperature can be individually selected. For instance, the relative temperatures of the two heated temperature zones in FIGS. 1 and 2 depend upon the number, pattern, and diameter of the perforations and the height of the first temperature zone from the second temperature zone. For example, a requirement of 100° C./180° C. versus 100° C./160° C. would require more perforations for cooling.

The invention has been described in detail with particular reference to preferred embodiments thereof, but it will be understood that variations and modifications can be effected within the spirit and scope of the invention.

I claim:

1. Apparatus for preheating, drafting, and stabilizing in sequence a running yarn strand, said apparatus comprising:

a heated shoe device having a pair of oppositely facing convex surfaces adapted to be heated and over which said running yarn strand travels in contact therewith to be heated to a predetermined temperature, and means for heating said pair of oppositely facing convex surfaces, a first freely rotating idler roll and a second freely rotating idler roll spaced one from the other and upstream along a running yarn strand path from said heated shoe device at one end thereof, a third freely rotating idler roll and a fourth freely rotating idler roll spaced one from the other and downstream along said running yarn strand path from said heated shoe device at the opposite end thereof, and a fixed draw pin spaced upstream along said running yarn strand path from said first and second freely rotating idler rolls, said freely rotating idler rolls and said heated shoe device together defining multiple running yarn strand paths for said running yarn strand as said running yarn strand passes back and forth along said yarn strand paths a predetermined number of times over said first freely rotating idler roll, along one of the pair of oppositely facing convex surfaces of said heated shoe device to said fourth freely rotating idler roll for return over said heated shoe device along the other of said pair of oppositely facing convex surfaces of said heated shoe device, next from said fourth freely rotating idler roll over said heated shoe device to and around said fixed draw pin for drawing said running yarn strand, and then from said draw pin back and forth over said second freely rotating idler roll, heated shoe device, and said third freely rotating idler roll a predetermined number of times before exiting downstream along said running yarn strand path from said apparatus, and said heated shoe device defining along the width of its pair of oppositely facing convex surfaces a first temperature zone for preheating said running yarn strand in its back and forth travel between said first and fourth freely rotating idler rolls, and a second temperature zone for heat stabilizing said running yarn strand in its back and forth travel between said second and third freely rotating idler rolls at a temperature higher than said first temperature zone.

2. Apparatus as defined in claim 1 wherein the side wall of said heated shoe device adjacent to said second temperature zone is provided with means for cooling each of the pair of oppositely facing convex surfaces of said heated shoe device along said first temperature zone.

3. Apparatus as defined in claim 2 wherein said means for cooling each of the pair of oppositely facing convex surfaces of said heat shoe device comprises perforations through said side wall adjacent to said second temperature zone.

4. Apparatus as defined in claim 1 wherein insulating means is provided between said first and said second temperature zones, and said means for heating said heated shoe device includes a separate heating means for each of said temperature zones.

5. Apparatus as defined in claim 1 wherein each of said pair of oppositely facing convex surfaces has slots formed therethrough along the direction of the length of the heated shoe device along said running yarn strand paths within said first temperature zone and said running yarn strand travels within said slots out of contact with the surfaces of said heated shoe device.

6. Apparatus as defined in claim 1 wherein the axes of said fixed draw pin and freely rotating idler rolls lie in a common plane, which is also coextensive with the axial length of said heated shoe device.

* * * * *